United States Patent [19]

Nelson

[11] 4,277,223

[45] Jul. 7, 1981

[54] CASE CONSTRUCTION FOR MULTI-STAGE PUMP

[75] Inventor: Richard M. Nelson, Portland, Oreg.

[73] Assignee: Guy F. Atkinson Company, Portland, Oreg.

[21] Appl. No.: 98,473

[22] Filed: Nov. 29, 1979

[51] Int. Cl.[3] ..... F04D 29/42

[52] U.S. Cl. ..... 415/199.1; 415/219 C

[58] Field of Search ..... 415/199.1, 219 C, 219 R, 415/199.2, 199.3, 199.6, 196, 98, 110, 113, 128, DIG. 3

[56] References Cited

U.S. PATENT DOCUMENTS

| | | | |
|---|---|---|---|
| 3,044,684 | 7/1962 | Fullemann | 415/199.2 |
| 3,717,418 | 2/1973 | Pilarczyk | 415/199.1 X |
| 3,801,217 | 4/1974 | Ryall et al. | 415/219 C X |
| 3,915,588 | 10/1975 | Brandstätter | 415/219 RX |
| 3,937,589 | 2/1976 | Remberg | 415/219 R X |
| 3,942,907 | 3/1976 | Meylan | 415/219 R X |
| 4,098,558 | 7/1978 | Bush et al. | 415/199.1 |
| 4,190,395 | 2/1980 | Ball | 415/199.2 X |

*Primary Examiner*—Leonard E. Smith

*Attorney, Agent, or Firm*—Klarquist, Sparkman, Campbell, Leigh, Hall & Whinston

[57] ABSTRACT

A double-case, multi-stage, centrifugal pump having a plurality of impellers mounted on a common shaft at axially spaced pump stages. The first pump stage is housed within a unitary forward case section of a three-section inner case assembly. Subsequent stages are housed within two rearward case sections disposed in axial joint-forming relationship with each other and radial joint-forming relationship with the forward case section. The inner case assembly is supported within an outer case assembly which provides a suction chamber surrounding the forward case section and a discharge chamber surrounding the rearward case sections, the inner and outer case assemblies being constructed in such manner that the pressure in the discharge chamber sealably forces the inner case sections together during operation of the pump.

7 Claims, 3 Drawing Figures

CASE CONSTRUCTION FOR MULTI-STAGE PUMP

BACKGROUND OF THE INVENTION

The present invention pertains generally to multi-stage pumps and more particularly to the case construction of multi-stage, volute-type centrifugal pumps.

It has been the practice in the art to provide an inner pump-case construction that is axially split at all pump stages, which consist of a first stage and one or more booster stages. It is known to employ the relatively high pressure in a discharge chamber formed within an outer case and surrounding the booster stages as a means for forcing the axially split booster-stage case sections together to form a fluid-tight joint between case sections. However, since the first-stage case section is provided within a chamber in fluid communication with a relatively low pressure inlet, it is not possible to form a fluid-tight joint between the axially split inner case sections employed at the first stage in prior art pumps. Rather, it has been the practice to employ bolts or other fastening means to secure such first-stage inner case sections together in a fluid-tight manner.

The seal formed by such bolting arrangements is subject to deterioration capable of affecting the performance of the pump and can eventually render the pump inoperable. Those skilled in the art will appreciate that there are additional problems with such bolting arrangements, especially for pumps that develop very high energy per stage. For example, there are practical limitations on the number and size of bolts that can be used to seal the joint between the axially split inner case sections of the first stage due to, among other things, design considerations in minimizing hydraulic flow interference between the outer-case inlet and the first stage.

It would be desirable, therefore, to provide a case construction for a double-case, multi-stage pump which would overcome the aforementioned problems encountered in the prior art and thereby eliminate the eventuality of pump failure due to leakage at the joint between the first-stage sections of the inner case assembly.

SUMMARY OF THE INVENTION

In accordance with the present invention, a multi-stage pump having inner and outer case assemblies is constructed so that the discharge pressure developed by the pump itself during operation seals an axial joint between two inner-case sections, which house one or more booster stages, and seals a radial joint between a unitary inner-case section, which houses a first pump stage, and cooperating portions of the two booster-stage case sections.

The novel features believed characteristic of the invention are set forth in the appended claims. The nature of the invention, however, as well as its essential features and advantages may be understood more fully upon consideration of an illustrative embodiment when read in conjunction with the accompanying drawing.

DESCRIPTION OF THE PREFERRED EMBODIMENT

Figure 1:
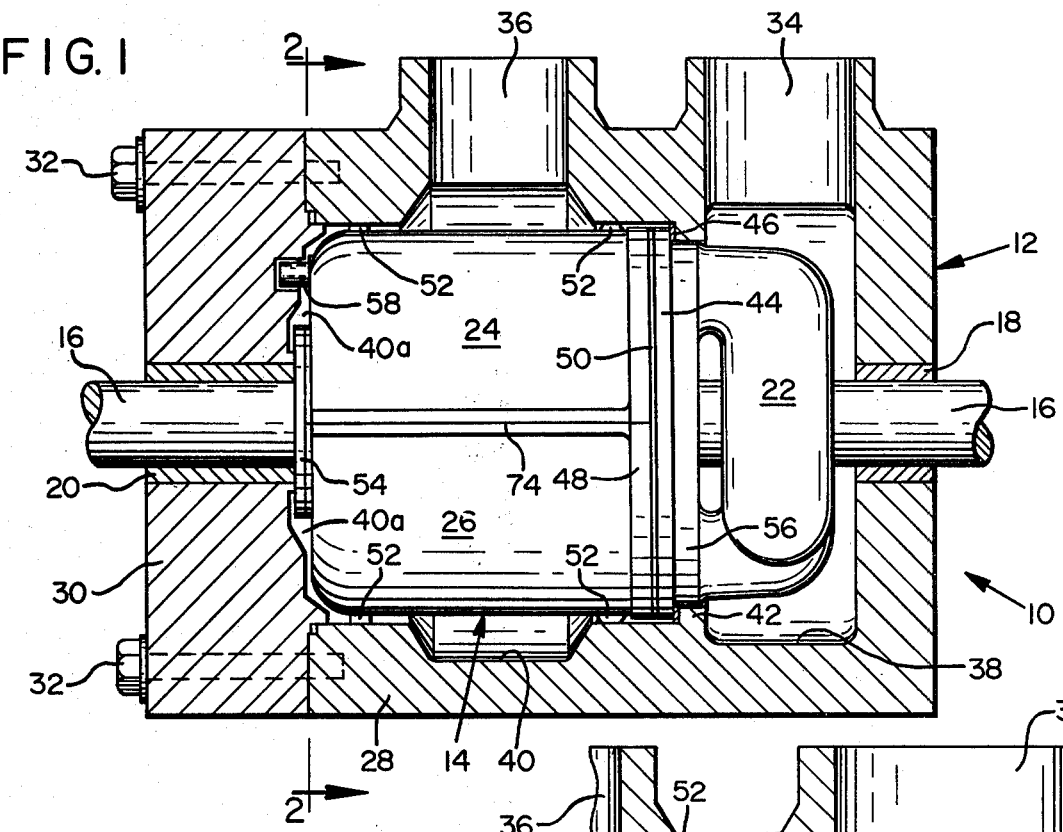
FIG. 1 is a vertical side view, partially in elevation and partially in section, of a pump construction in accordance with the present invention.

Referring to FIG. 1, a preferred embodiment of a double-case, multi-stage pump is illustrated and designated generally by reference numeral 10. The pump 10 is characterized by an outer pump case 12 enclosing an inner pump case 14 in which a plurality of pump stages are housed, as will be described in greater detail below. The pump 10 has a shaft 16 extending through conventional seals 18 and 20 in the outer case 12 to drive the stages within the inner case 14.

In accordance with an important feature of the present invention, the preferred inner pump case 14 comprises an assembly of three case sections consisting of a unitary annular case section 22 housing a first pump stage, an upper case section 24 and a lower case section 26, the upper and lower case sections 24 and 26 together housing one or more booster pump stages. It will be understood that the terms "upper" and "lower" as well as similar directional terms used in this specification and the appended claims are intended only to be descriptive of the various parts in relation to their orientation in the views of the drawing and are not to be construed as limiting the claimed invention to the particular pump construction and orientation of parts illustrated. For example, it will be appreciated that the invention has equally advantageous application to a pump whose shaft is oriented vertically rather than horizontally as depicted in the figures. In addition, the terms "forward" and "rearward" will be used herein with reference to the right and left ends, respectively, of the pump 10 as viewed in FIG. 1.

As is customary for double case pumps, several booster stages are housed within the assembly of the axially split rearward sections 24 and 26. The case sections 22, 24, and 26, which comprise the three-part assembly of the inner case 14, are forced together by the discharge pressure developed by the pump 10 during operation and are held in sealed engagement with one another by cooperating surfaces of the outer case 12 in a manner which will presently be described.

The preferred outer case 12 comprises a pump block 28 and an end cover 30 assembled in a conventional manner such as by bolts 32. The pump block 28 includes an inlet port 34 and an outlet port 36. The inlet port 34 communicates with a suction chamber 38 surrounding the forward case section 22 which houses the first pump stage, and the outlet port 36 communicates with a discharge chamber 40 surrounding the rearward case sections 24 and 26 which house the booster stages. The discharge chamber 40 includes a portion **40*a* extending radially inward along the rearward surfaces of the case sections 24 and 26 in order to exert a forwardly acting force on the case sections 24 and 26 for purposes to be described below. The interior surface of the block 28 is provided with an annular rim 42 which defines a seat for an annular flange 44 radially disposed on the forward case section 22. A conventional sealing gasket 46 is provided in a radial plane between the rim 42 and flange 44. The rearward case sections 24 and 26 each include a semicircular portion of an annular flange 48 adapted to mate with the flange 44 on the forward case section 22. A gasket 50 provides a sealed joint in a radial plane between the flanges 44 and 48**.

Figure 2:
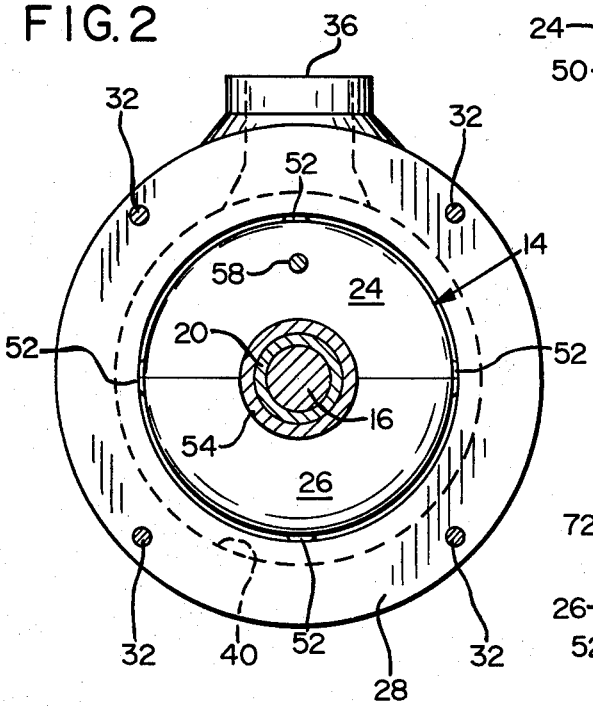
FIG. 2 is a cross section of the pump of FIG. 1 taken along line 2—2 of FIG. 1.

To facilitate assembly of the pump 10, the rearward case sections 24 and 26 are provided with lugs 52 adapted to abut the interior surfaces of the pump block 28 preferably at ninety-degree spacings around the sections 24 and 26, as seen best in FIG. 2. Once assembled, a conventional close tolerance registration fit between the case sections 22, 24 and 26 maintains concentric alignment of the rearward case sections 24 and 26 relative to the forward case section 22. The case sections 24 and 26 are also maintained in concentric alignment relative to the shaft 16 by a bushing 54 inserted into the rearward end of the assembled sections 24 and 26, proper alignment of the bushing 54 being maintained by the cover 30. Concentric alignment of the forward case section 22 is maintained by a close tolerance fit between the annular rim 42 of the pump block 28 and a cylindrical surface 56 of the case section 22, as depicted in FIG. 1. Seen in both FIGS. 1 and 2 is an alignment stud 58 which extends into cavities in the walls of the end cover 30 and the upper rearward case section 24 to assure proper angular orientation of the case sections 24 and 26 within the pump block 28.

Figure 3:
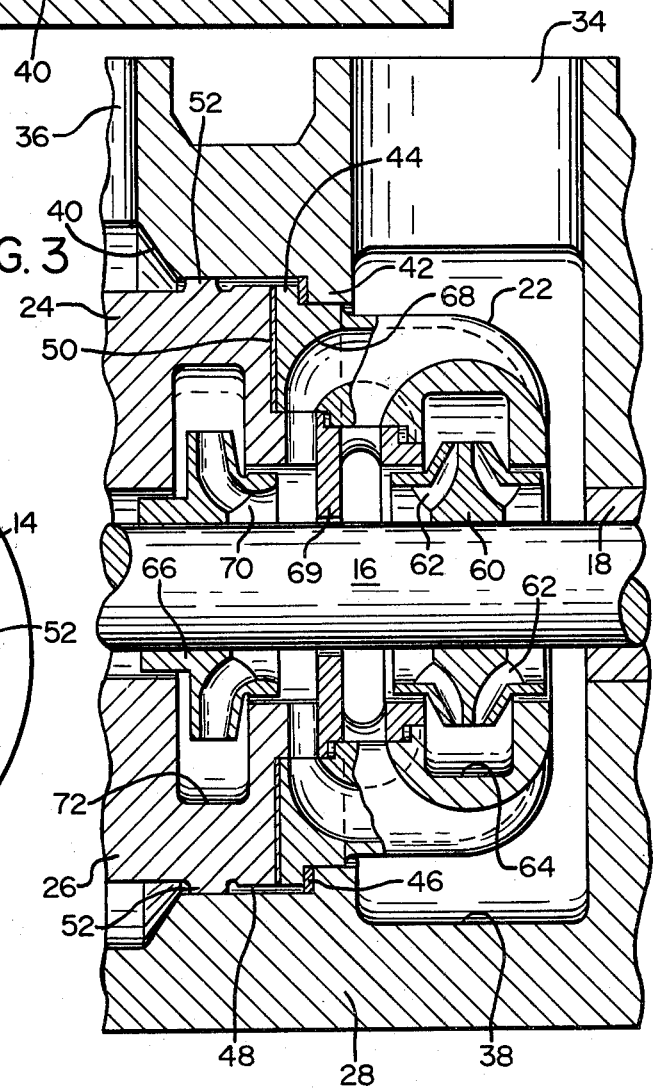
FIG. 3 is an enlarged fragmentary view of a portion of the pump of FIG. 1 wherein both inner and outer case assemblies are sectioned.

Various features of the internal working parts of the pump 10 will now be described with reference to FIG. 3, which illustrates the first pump stage and the first of several similarly constructed booster stages. The first pump stage is characterized by an impeller 60 assembled for rotation with the shaft 16 in a known manner. The impeller 60, which in this example is of the type known in the art as a double-suction impeller, includes a plurality of nozzles 62 adapted to draw fluid from the chamber 38 surrounding the forward case section 22 and expel the fluid radially outward into a first-stage volute chamber 64 in which kinetic energy of the fluid is converted into pressure energy. Downstream from the first-stage impeller 60 within the forward end of the axially split case sections 24 and 26 is a first booster-stage impeller 66 secured for rotation with the shaft 16 in a known manner. An internal cross-over passageway 68 within the forward case section 22 and formed in part by a stage piece 69 provides fluid communication between the first-stage volute chamber 64 and a chamber 70 at the mouth of the booster-stage impeller 66. Fluid drawn from the chamber 70 by the impeller 66 is expelled radially upward into a booster-stage volute chamber 72 which is in fluid communication with the discharge member 40 via subsequent booster stages (not shown) as will be appreciated by those skilled in the art.

Referring again to FIG. 1, the unique operational features of the pump 10 will now be described. It will be appreciated that each pump stage increases the fluid pressure such that the lowest fluid pressure within the pump 10 exists in the suction chamber 38 surrounding the forward case section 22 and the highest fluid pressure exists in the discharge chamber 40 surrounding the axially split rearward case sections 24 and 26. Since the fluid pressure in the discharge chamber 40 exceeds the fluid pressures in the internal passageways within the case sections 24 and 26, the case sections 24 and 26 are forced together during operation of the pump 10 by the pressure differential thereby created. Therefore, a fluid-tight joint 74 is formed between the mating surfaces of the case sections 24 and 26 during operation of the pump 10. The mating surfaces at the joint 74 are precisely machined to avoid leakage and do not require a sealing gasket. The relatively high pressure within the discharge chamber 40 also extends into the rearward portion 40*a* of the chamber 40 so that the force of the pressure acts against the rearward surfaces of the case sections 24 and 26 to force the case sections 24 and 26 forwardly into compressive engagement with the gasket 50 in order to form a fluid-tight seal between the annular flange 44 of the forward case section 22 and the mating annular flange portions 48 of the rearward case sections 24 and 26. The stage piece 69 is held firmly in position and sealed against leakage by the clamping action between the forward case section 22 and the rearward case sections 24 and 26. Furthermore, it will be appreciated that the relatively high fluid pressure in the discharge chamber 40 also causes the annular flange 44 to be forced forward into sealing engagement with the gasket 46 and adjacent annular rim 42 to form a fluid-tight seal between the chambers 38 and 40.

Since the internal pressure within the forward case section 22 exceeds the fluid pressure in the surrounding chamber 38, the provision of a unitary structure for the case section 22 avoids any potential problems with leaky joints or seals which are characterized by prior art pumps using an axially split, first-stage case section as described above in the background portion of the specification.

From the foregoing description of the presently preferred embodiment of the invention, it will be apparent that the invention provides an effective and economical technique for sealably isolating the various fluid passageways of a double-case, multi-stage pump. Although a preferred embodiment of the invention has been described in detail, it is to be understood that various changes, substitutions and alterations can be made therein without departing from the spirit and scope of the invention as defined in the appended claims.

What is claimed is:

1. A pump apparatus comprising:

an outer case assembly having an inlet port leading to a suction chamber at a forward end of the pump and an outlet port leading to a discharge chamber at a rearward end of the pump;

a shaft sealably extending through walls of the outer case assembly;

an inner case assembly disposed within the outer case assembly and having a plurality of pump stages which are axially spaced along the shaft to povide fluid communication between the suction chamber and the discharge chamber, the pump stages including a first stage and one or more booster stages, each pump stage being characterized by an impeller secured for rotation with the shaft, the inner case assembly having an interior network of hydraulic passages for fluid communication between successive pump stages, the inner case assembly being characterized by a forward case section of a unitary annular construction housing the first pump stage and two rearward case sections housing the booster pump stages, an axial joint being defined between adjacent surfaces of the rearward case sections, a radial joint being defined between a surface of the forward case section and adjacent surfaces of the assembled rearward case sections, the forward case section being surrounded at least in part by the suction chamber, the rearward case sections being surrounded at least in part by the discharge chamber; and locating means provided on an interior wall of the outer case assembly for preventing the forward movement of the forward case section beyond a predetermined position within the outer case;

whereby the fluid pressure within the discharge chamber during operation of the pump applies a radially acting force to the rearward case sections to form a fluid-tight seal at the axial joint and applies an axial force acting in the forward direction against the rearward case sections to form a fluid-tight seal at the radial joint.

2. The pump apparatus of claim 1 wherein the axis of the shaft is coplanar with the axial joint defined between the rearward case sections of the inner case assembly.

3. The pump apparatus of claim 1 further comprising a stage piece carried within the forward case section for separating the suction chamber from the portion of the network of hydraulic passages leading to the impeller disposed in the booster pump stage most proximate to the first pump stage, wherein the stage piece is held in position during operation at least in part by the force of the pressure in the discharge chamber acting axially forward on the rearward case sections of the inner case assembly.

4. The pump apparatus of claim 1 wherein the locating means comprises an annular rim formed on an interior wall of the outer case assembly, and the forward case section is further characterized by an annular flange at its rearward extremity adapted to form a fluid-tight seal with the annular rim to prevent leakage between the discharge chamber and the suction chamber.

5. The pump apparatus of claim 4 further comprising:

a first sealing gasket disposed between the annular rim of the outer case assembly and the annular flange of the forward case section of the inner case assembly; and a second sealing gasket disposed at the radial joint between the forward and rearward case sections of the inner case assembly.

6. The pump apparatus of claim 1 wherein the outer case assembly is further characterized by two principal unitary case members consisting of a pump block and an end cover secured to the rearward end of the pump block, and wherein the pump block surrounds substantially the entire inner case assembly.

7. The pump of claim 6 wherein the discharge chamber includes a portion between the end cover and the rearward surfaces of the rearward case sections for applying said axial force against the rearward case sections.

* * * * *